US008148619B1

(12) United States Patent
May et al.

(10) Patent No.: US 8,148,619 B1
(45) Date of Patent: Apr. 3, 2012

(54) DRUM DAMPING FIXTURE

(75) Inventors: James H. May, Valencia, CA (US); Robert Alan Yerby, Sylmar, CA (US); Brian Timothy LeVan, Valencia, CA (US)

(73) Assignee: Remo, Inc., Valencia, CA (US)

( * ) Notice: Subject to any disclaimer, the term of this patent is extended or adjusted under 35 U.S.C. 154(b) by 0 days.

(21) Appl. No.: 12/929,269

(22) Filed: Jan. 12, 2011

(51) Int. Cl.
*G10D 13/02* (2006.01)

(52) U.S. Cl. ..... 84/411 M; 84/411 R

(58) Field of Classification Search ..... 84/411 M, 84/411 R, 417, 421
See application file for complete search history.

(56) References Cited

U.S. PATENT DOCUMENTS

| | | | | |
|---|---|---|---|---|
| 5,088,376 | A | 2/1992 | Crago et al. | |
| 5,107,741 | A | 4/1992 | Beals et al. | |
| 5,892,168 | A | 4/1999 | Donohoe | |
| 6,291,754 | B1 | 9/2001 | Gatzen et al. | |
| 7,476,794 | B2 * | 1/2009 | May, Jr. | 84/411 R |

* cited by examiner

*Primary Examiner* — Kimberly Lockett
(74) *Attorney, Agent, or Firm* — Beaumont Gitlin Tashjian; Larry F. Gitlin

(57) ABSTRACT

In combination with a musical drum with a hollow shell having at least one opening and a drumhead with a tensioned membrane with a playing surface covering the opening, the present invention is an improved means to dampen resonating drum sounds consisting of an annular fixture mounted on a playing surface with the fixture having an outer concentric edge adjacent a flange member having an inner surface faced opposed to the playing surface, an inner concentric edge spaced apart from said playing surface and an area adjacent the inner concentric edge which defines an annular channel with the drumhead for receiving a damping member in fixed retained relation with the annular fixture. The annular fixture, including the damping member, is mounted to the playing surface by a series of incrementally spaced-apart non-adhesive means or non-adhesive means disposed in a continuous array provided for attaching the flange member to the playing surface. Included in near conformal reflation with the inner surface of the flange member is the means to reduce or eliminate vibration and vibrational-generated noise occurring along sections of the drumhead where the inner surface and playing surface coincide and touch, when the drumhead is struck.

11 Claims, 6 Drawing Sheets

DRUM DAMPING FIXTURE

FIELD OF THE INVENTION

The present invention relates generally to the field of musical drums and, more particularly, to an improved apparatus that dampens the sound of a drum to increase its acoustical appeal.

DESCRIPTION OF THE PRIOR ART

The drum is a member of the percussion group of musical instruments referred to as membranous because the drum includes at least one membrane called a drumhead. The drumhead typically is stretched over one or both ends of a shell, which is a hollow cylinder or vessel that may vary in width and height and even shape depending upon the desired characteristics of the drum sounds and other aesthetic factors. Sounds are produced by striking the drumhead with a stick, mallet, brush or even the player's hand. With modern band and orchestral drums the drumhead is placed over the opening of the drum, which is usually mounted to the shell by a counterhoop and secured to the shell by a series of tensioning rods that screw into corresponding lugs placed evenly around the outer shell surface. The head's tension can be adjusted by simply tightening or loosening the rods. The sound of a drum depends upon a variety of factors, including, without limitation, the shape, size and thickness of the shell, the materials from which the shell is fabricated, the counterhoop material, the material comprising the drumhead (typically polyester) and the amount of tensioning applied to the drumhead.

Well-known in the prior art are the persistent problems with resonant overtones and the associated undesirable high frequency sounds and lingering decay time. A variety of means and efforts have been attempted over the years to address these problems, particularly efforts to dampen, reduce or even eliminate decay times and decrease the amplitude of undesirable high frequency sounds produced when the drumhead is struck. Included among these means and efforts are simple measures, such as the placement of a blanket or pillow or some similar material inside a drum shell, the placement of adhesive or some other type of material such as fabric, paper, plastic or the like, directly on the drumhead of any type of drum, either upon the battered surface or the non-battered side of the drumhead. However, the results of these efforts have been inconsistent and often unreliable. Aside from the unsightly appearance of many of these materials, other problems continue to persist, including the inability to use the entire surface area of the playing surface in an effort to avoid striking the area affected or covered by the damping material. Another issue with these prior art efforts to dampen frequencies and reduce decay is the tendency for many, if not all, of these damping materials to cause an uneven muffling of the drum sounds because of the uneven distribution of these materials on the drumhead.

Drumset bass drums have been particularly difficult to muffle consistently because of the performance techniques employed with the bass drum pedal. Some players, for example, prefer to drop their entire leg on the pedal, forcing the pedal beater to remain against the head on impact. This results in a fast decayed sound and a sound with increased high frequencies. Other drummers play with their heel down, which allows the beater to retreat from the drumhead after impact. The result in this instance is a sound that has a longer decay.

U.S. Pat. No. 5,892,168 discloses a drumhead with a floating sound absorbing muffling ring attached to the drum for the purpose of minimizing the amplitude and duration of undesirable resonance sounds or sound decay. The muffling ring is flat, wide and annular and is attached to the inside or non-battered surface of the drumhead at various intervals to allow the portions of the ring in between the secured locations to float. This also allows the unattached sections to momentarily move away from the drumhead membrane when the playing surface is struck by an object, and then immediately return into contact with the membrane. The objective is to minimize the attenuation of the membrane vibrations produced when the head is struck resulting in a more desirable sharp sound with reduced decay. This device tends to remove all high and mid-frequencies from the drumhead resulting in a sound similar to the pillow damping systems disclosed in U.S. Pat. Nos. 5,107,741 and 5,088,376. However, this type of muffling generally detracts from the clarity and crispness of the initial drum sound produced by the struck membrane. The volume of the sound is also reduced because the muffling ring, being so wide with such a large surface area, absorbs too much sound energy.

The disadvantages associated with this arrangement also include the inability to easily access the device to replace it or to make adjustments or repairs since the device is positioned against the non-battered surface of the drumhead inside the shell chamber. Another disadvantage is the additional and often undesirable suppression of the drum sounds caused by the positioning of the device inside the shell chamber, which creates its own muffling effect in addition to the effect brought about by the urging of the muffling ring against the membrane.

U.S. Pat. No. 6,291,754 B1 illustrates a muffling means consisting of an externally mounted damping fixture that is adhesively attached to the periphery of the drumhead playing surface. The fixture defines an annular channel for receiving a removable muffling ring made of a variety of materials, preferably foam. A serious disadvantage associated with this device is the exclusive use of adhesive to bond the fixture to the periphery of the drumhead membrane. Initially, the adhesive connection appears secure and the bond between the entire peripheral portion of the fixture and the membrane is intact. Eventually, however, the adhesive bond begins to deteriorate. The bond becomes dry and brittle and loses its adhesive quality. This, in turn, causes the fixture to loosen all around its periphery, which creates a variety of undesirable sounds produced from the clattering of the separated fixture sections hitting against the drum membrane whenever the membrane is struck and made to vibrate. This, coupled with the uneven muffling of the drum sounds wherever portions of the fixture and the membrane experience a lost connection around the membrane's periphery, seriously undermines the otherwise intended positive attributes and purpose of the fixture and relegates the device to inferior status.

U.S. Pat. No. 5,892,168 uses a bearing edge tray positioned beneath the drumhead. Various foam rings and discs may be used in combination with the tray. Because this system is not attached to the drumhead, there is a loss of sound volume and increase in decay time similar to the results experienced with the pillow systems.

The drum damping fixture of the present invention resolves the problems of the prior art by providing an improved apparatus consisting of a fixture coupled with an attached damping element externally mounted upon the peripheral sections of the playing surface of the drumhead using non-adhesive connections, either incrementally spaced-apart or disposed in a continuous array, to attach the fixture to the drumhead. This is coupled with a buffering material or gasket adhered to the underside of the periphery of the fixture to ensure a sustainable permanent connection and the elimination of vibration noise that otherwise might be caused by loose segments of the fixture's periphery hitting against the membrane.

SUMMARY OF THE INVENTION

In its preferred embodiment, the present invention provides, in combination with a musical drum with a hollow shell having at least one opening and a drumhead with a tensioned membrane with a playing surface covering the opening, an improved means to dampen resonating drum sounds produced upon the striking of the drumhead. The damping means consists of an annular fixture mounted on a playing surface with the fixture having an outer concentric edge adjacent a flange member having an inner surface faced opposed to the playing surface, an inner concentric edge spaced apart from said playing surface and an area adjacent the inner concentric edge which defines an annular channel with the drumhead for receiving a damping member in fixed retained relation with the annular fixture. The annular fixture, which includes the damping member, is mounted to the playing surface by a series of incrementally spaced-apart non-adhesive means or non-adhesive means disposed in a continuous array provided for attaching the flange member to the playing surface. Included in near conformal reflation with the inner surface of the flange member is the means to reduce or eliminate vibration and vibrational-generated noise occurring along the sections of the drumhead where the inner surface and playing surface are joined, when the drumhead is struck.

Accordingly, it is an object of the present invention to provide an improved device for damping resonating sounds produced by a battered drumhead membrane.

It is another object of the present invention to provide an improved device for damping resonating sounds emanating from a battered drumhead membrane that utilizes non-adhesive means to secure the damping device to the drumhead playing surface.

Yet another object of the present invention is to provide an improved device for incrementally spaced-apart non-adhesive means to secure the damping device to the drumhead playing surface.

Still another object of the present invention is to provide an improved device for damping resonating sounds emanating from a battered drumhead membrane that utilizes non-adhesive means disposed in a continuous array to secure the damping device to the drumhead playing surface.

Yet another object of the present invention is to provide an improved device for damping resonating sounds produced by a battered drumhead membrane which includes the means to control, either by reduction or elimination, vibration and vibrational-generated noise where the damping device and playing surface make contact at and along the membrane's periphery.

It is yet another object of the present invention to provide an improved device for damping resonating sounds produced by a battered drumhead membrane that is easy and cost effective to manufacture.

It is yet another object of the present invention to provide an improved device for damping resonating sounds produced by a battered drumhead membrane that is easy to mount and secure upon the playing surface of a drumhead and convenient to access for repairs or replacement of any of its component parts.

Other objects and advantages of the present invention will become apparent in the following specifications when considered in light of the attached drawings wherein the preferred embodiment of the invention is illustrated.

DETAILED DESCRIPTION OF THE PREFERRED EMBODIMENT

Figure 1:
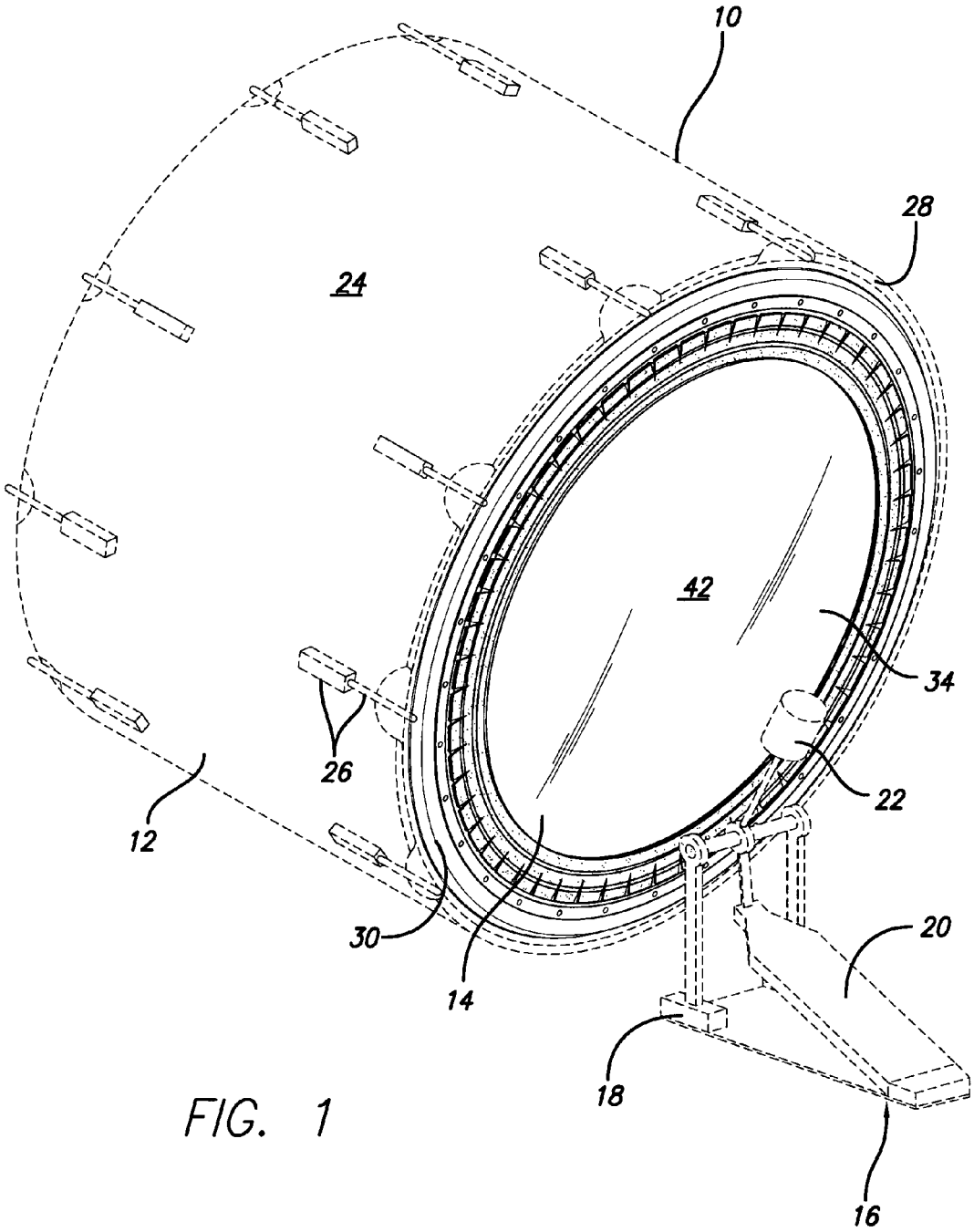
FIG. 1 is a front perspective view of a drumset bass drum including the device for damping resonating sounds produced by a battered drumhead in accordance with the present invention.

FIG. 1 illustrates the preferred embodiment of the improved musical drum in accordance with the present invention shown in combination with drumset bass drum 10.

Bass drum 10 includes a hollow cylindrical shell 12 and a drumhead 14. Also shown is a bass pedal assembly 16, including support legs 18, foot pedal 20 and a mallet 22 that, upon depressing foot pedal 20, is caused to beat against drumhead 14 to produce drum sounds. Mounted around outer wall 24 of shell 12 are a series of tensioning rods and lugs 26 used to tension drumhead 14. Attached to and covering one end 28 of shell 12 is a drumhead assembly 30 consisting of a counterhoop 32, which fits securely over end 28 of shell 12 and is held tightly in that position by tensioning rods and lugs 26, which serve also to adjust the tensioning of drumhead 14. Also part of drumhead assembly 32 is membrane 34, which is formed to span the interior space defined by counterhoop 32 and is secured there by the placement of annular edge portions 36 into circumferential channel 38 formed within counterhoop 32 into which any suitable resin material 37 is poured and allowed to cure. Application of the present invention extends to various other drums, including, without limitation, marching and handheld bass drums (not shown).

Drumhead 14 comprises an inside or non-battered surface 40 and an outer or battered surface 42 also known as the playing surface, and a peripheral section 41.

Figure 2:
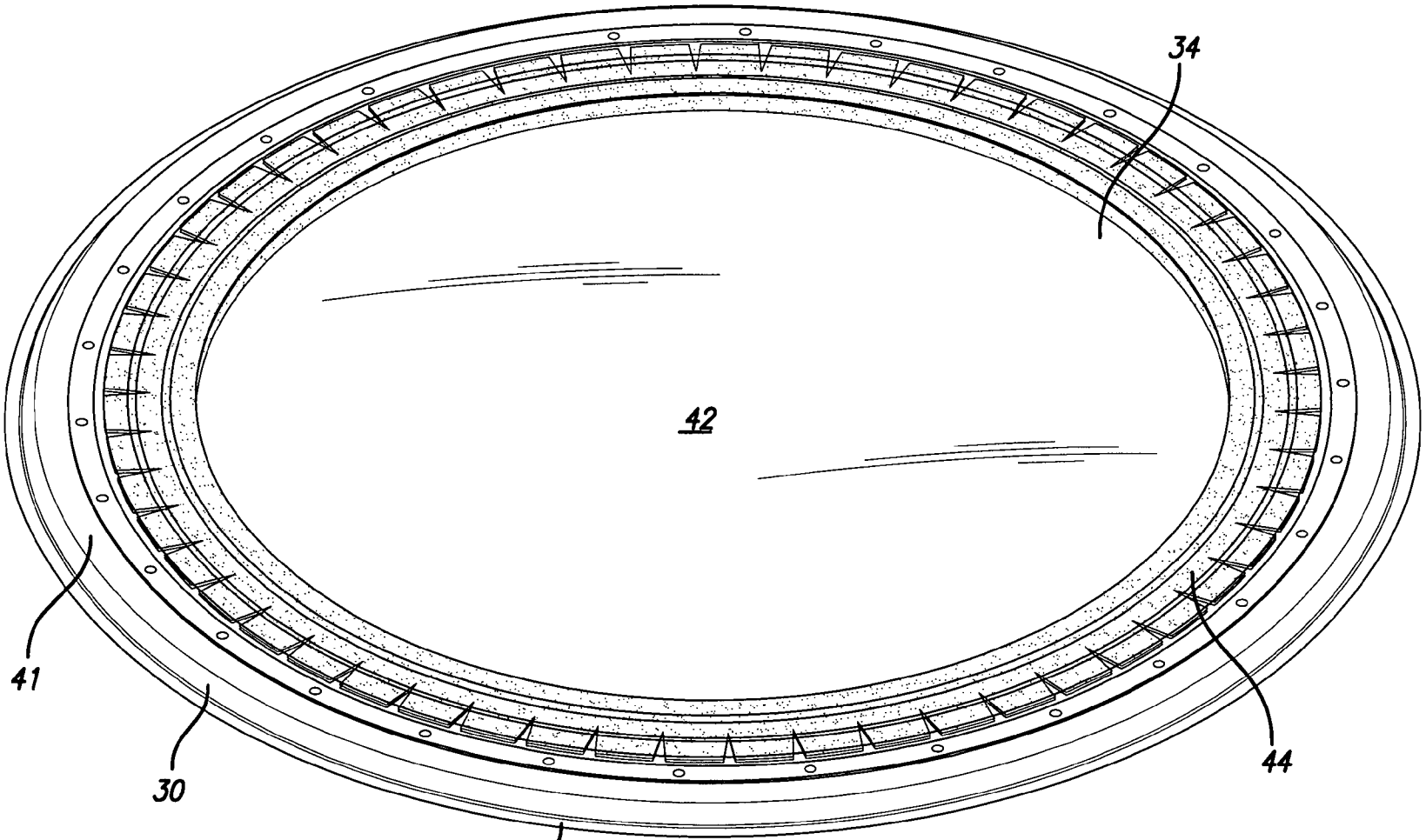
FIG. 2 is a perspective view of the device for damping resonating sounds produced by a battered drumhead in accordance with the present invention.
Figure 3:
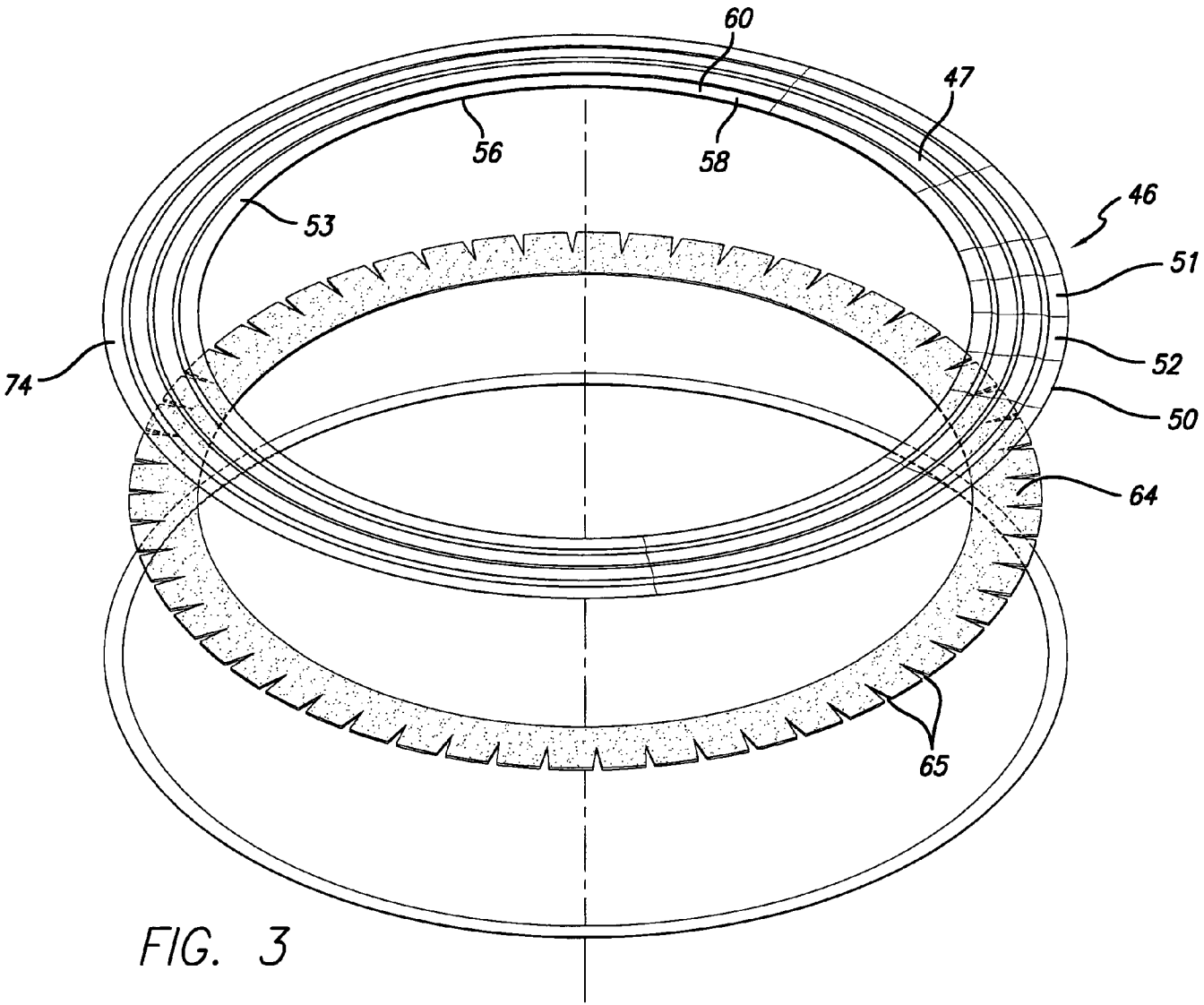
FIG. 3 is an exploded perspective view of the device for damping resonating sounds produced by a battered drumhead in accordance with the present invention.
Figure 4:
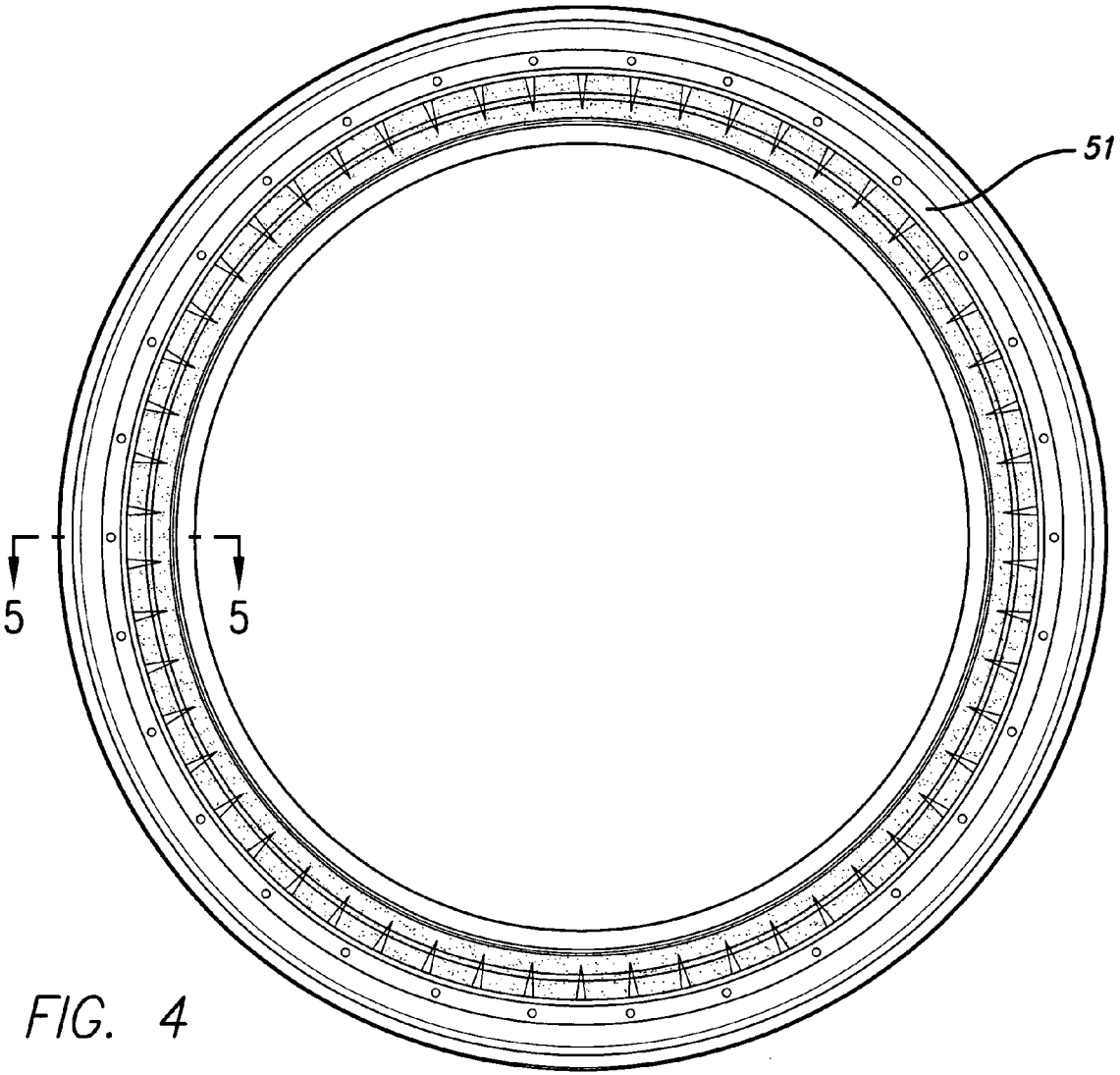
FIG. 4 is a front view of the device for damping resonating sounds produced by a battered drumhead in accordance with the present invention.
Figure 5:
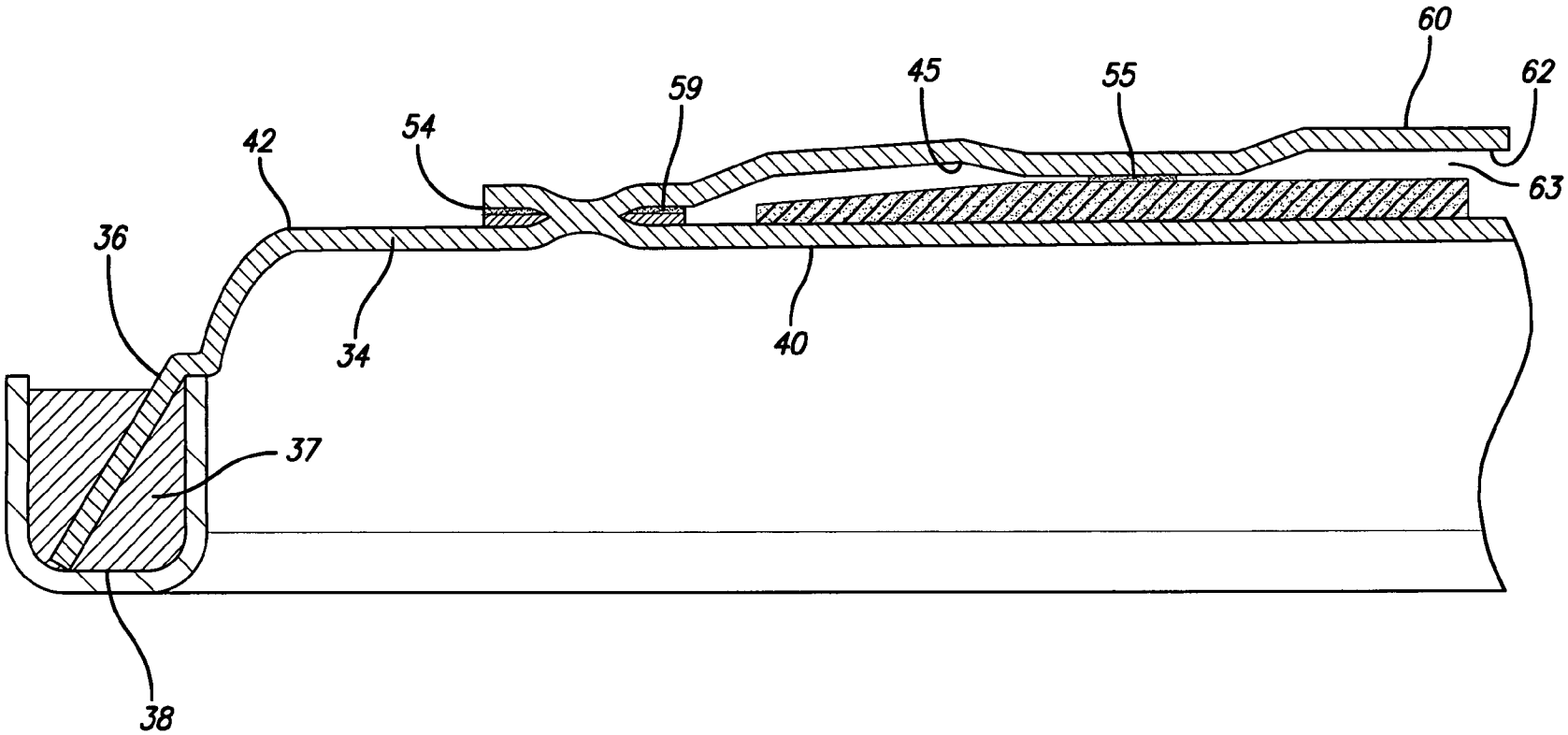
FIG. 5 is a partial sectional view of the device for damping resonating sounds of FIG. 4 in accordance with the preferred embodiment of the present invention, taken along line 5-5.
Figure 6:
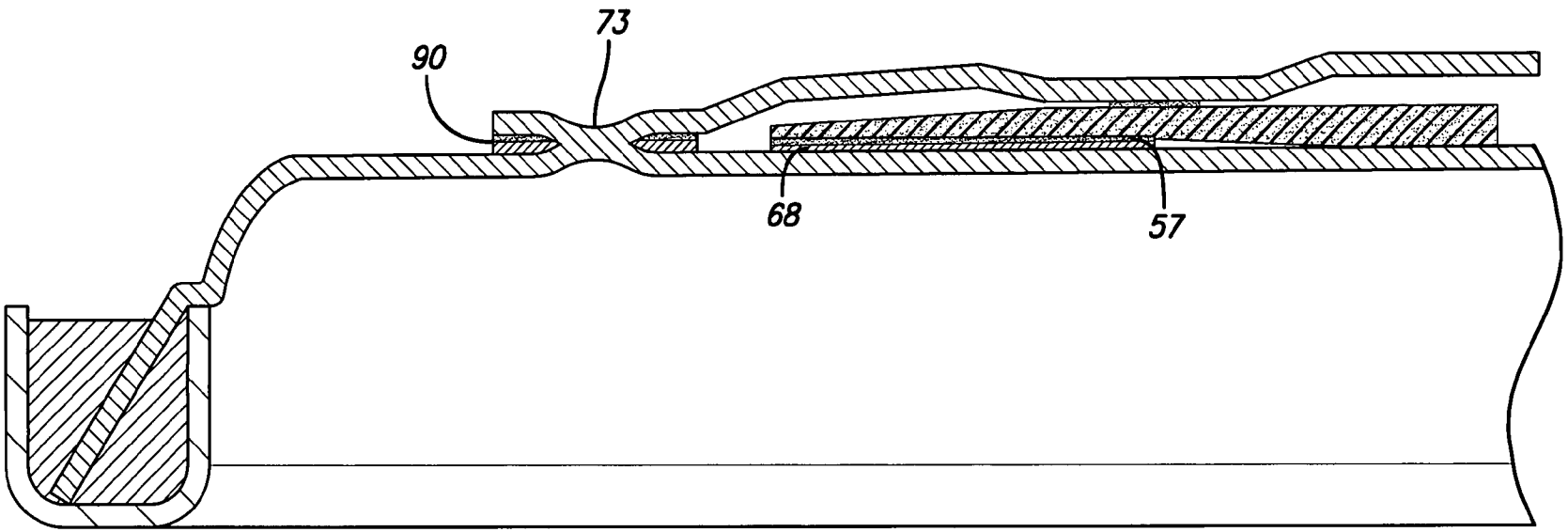
FIG. 6 is a partial sectional view of a device for damping resonating sounds in accordance with an alternative embodiment of the present invention.

Drum damping fixture 44 of the present invention is illustrated in its assembled form in FIGS. 2 and 4, in exploded view in FIG. 3, in combination with bass drum 10 in FIG. 1 and in cross-section in FIGS. 5 and 6.

Damping fixture 44 comprises annular ring 46 having an inside surface 45 and an outside surface 47. Fixture 44 is preferably made of polyester, but may also be made of any other suitable synthetic (e.g., thermo-set and thermo-plastic) or natural material, and is typically 0.01 inches thick, though the thickness may vary and range between 0.005 inches and 0.015 inches depending on a variety of conventional factors. Outer peripheral section 74 of fixture 44 includes an outer concentric edge 50 defining a flange 51 which has an outer surface 52 and an inner surface 54. Along interior peripheral section 53 of fixture 44 is inner concentric edge 56 defining radially inward portion 58 having an outer surface 60 and an inner surface 62. Fixture 44 typically has a tapered profile which, when laid flat and level, is higher along the area defined by inner concentric edge 56 and at its lowest point along the area defined by outer concentric edge 50.

Attached to inside surface 45 recessed in from inner concentric edge 56 is an annular damping member 64 commonly made of foam, felt, rubber, pipe cleaners, yarn, paper, air or gel filled packets, or any other appropriate natural or synthetic material having sound absorption properties suitable for reducing or eliminating drum membrane vibrations that cause delayed sound decay and undesirable high frequencies. Annular damping member 64 is preferably 1.375 inches (ranging between 0.75 and 2 inches) in width, and 0.25 inches (ranging between 0.125 and 0.375 inches) in thickness.

In its preferred embodiment, annular damping member 64 is wedge-shaped to conform to space 63 created beneath fixture 44 when fixture 44 is attached to drumhead 14. Annular damping member 64 includes a plurality of radial slots 65 to permit it to conform more easily when attached to inside surface 45 of fixture 44. Annular damping member 64 is attached to inside surface 45 between inner concentric edge 56 and outer concentric edge 50 using any suitable adhesive 55 or other means to enable a secure bond.

Fixture 44 may also employ other configurations, including, without limitation, those with a rectangular profile that is not tapered and that would accommodate an annular damping member 64 configured accordingly. An example might be a fixture 44 rectangularly configured with an attached annular damping member 64 of uniform thickness.

To assist in absorbing undesirable sounds produced by a struck membrane, annular damping member 68 may be utilized by attachment to annular damping member 64 in total or partial conformal relation using any suitable bonding agent 57 for this purpose. Annular damping member 68 is preferably 0.70 inches wide (ranging between 0.375 and 1.5 inches) and 0.0525 inches thick (ranging between 0.0625 and 0.090 inches) and is typically comprised of felt, though any material suitable for damping sounds, as detailed above, would likely be appropriate.

Bonded and conforming to inner surface 54 of flange 51 is annular gasket 90 provided to ensure against any, or at least any significant, fluttering of flange 51 against peripheral section 41. Gasket 90 is preferably 0.375 inches wide and 0.0312 inches thick but may range between 0.25 and 0.4 inches wide and between 0.03 and 0.0625 inches thick. Specifically, gasket 90 in combination with a series of welds 73, or any other suitable means, as detailed herein, prevents flange 51, either in the areas between the welds or laterally thereof, from hitting against peripheral section 41 as a result of the vibrations produced by the struck drumhead. Any suitable adhesive or other appropriate bonding agent or means 59 may be utilized to permanently secure inner surface 54 to gasket 90.

Damping fixture 44 in its assembled form is placed on top of battered surface 42 and situated so that the geometric centers of drumhead 14 and fixture 44 are in general alignment. Using ultrasonic welds, staples, rivets, stitches or any other non-adhesive suitable means, damping fixture 44 is attached to drumhead 14. In one example, a series of connector elements 72, such as a plurality of individual welds 73 placed at intervals around peripheral section 74 of fixture 44, are employed for this purpose. A continuous weld array disposed along peripheral section 74 is another may also be employed. Staples, rivets, stitches and other non-adhesive alternatives may be employed similarly. Each individual weld 73, when welding is the chosen means, is formed using conventional welding methods (e.g., ultrasonic) to unite or merge flange 51 with peripheral section 41 creating a plurality of generally evenly spaced welds to fix the two materials together. Ultrasonic welds may be of any shape or even, as detailed, one continuous welded bead or line. In the preferred embodiment, the weld is a polar array of thirty welds, with each weld being approximately 0.187 inches in diameter. The size of each weld may vary. For example, the diameter of circular welds may range between 0.125 inches and 0.312 inches.

Accordingly, in its preferred applications, damping fixture 44 dampens undesirable high frequencies of resonating sounds and reduces, if not altogether eliminates, associated sound decay by urging sound absorbing materials against a battered head after the head has been struck and sustains the life and long term effectiveness of the device by employing a series of spaced-apart non-adhesive means or non-adhesive means disposed in a continuous array that bond the fixture to the drumhead membrane, while serving the further purpose of maintaining the face-opposed surfaces of the fixture and the membrane in substantial or complete contact to reduce, if not entirely eliminate, any vibrational noise issues that are so associated and most prevalent with prior art devices constructed differently.

While the invention will be described in connection with a certain preferred embodiment, it is to be understood that it is not intended to limit the invention to that particular embodiment. Rather, it is intended to cover all alternatives, modifications and equivalents as may be included within the spirit and scope of the invention as defined by the appended claims.

The invention claimed is:

1. In a musical drum with a hollow shell having at least one opening and having a drumhead including a tensioned membrane with a playing surface covering said opening, the improvement comprising:

a means to dampen resonating sounds produced when said drumhead is struck by an object, said means to dampen said resonating sounds including an annular fixture mounted on said playing surface, said annular fixture having an outer concentric edge adjacent a flange member having an inner surface face-opposed to said playing surface, an inner concentric edge spaced-apart from said playing surface and an area adjacent said inner concentric edge defining an annular channel with said drumhead for receiving a damping member in fixed retained relation with said annular fixture, said annular fixture being mounted to said playing surface by non-adhesive means for permanently joining said flange member with said playing surface and including in near conformal relation with said face-opposed inner surface a means to reduce or eliminate vibration and vibrational-generated noise along the sections of the drumhead where said inner surface and said playing surface are joined, when said drumhead is struck.

2. The improved musical drum of claim 1 wherein said annular fixture is made from the group of materials comprised of thermo-set and thermo-plastic.

3. The improved musical drums of claim 1 wherein said non-adhesive means is made from the group comprised of a plurality of welds, staples, rivets and stitches.

4. The improved musical drum of claim 1 wherein said means to reduce or eliminate vibrational-generated noises is made from the group of materials comprised of felt, foam, fabric, paper, plastic and rubber.

5. The improved musical drum of claim 1 wherein said damping member is annular in shape.

6. The improved musical drum of claim 5 wherein said damping member is affixed to said annular fixture within said annular channel between said inner concentric edge and said outer concentric edge.

7. The improved musical drum of claim 1 wherein said damping member is adhesively fixed to said annular fixture.

8. The improved musical drum of claim 1 wherein said damping member is comprised of at least two annular members permanently affixed.

9. The improved musical drum of claim 8 wherein said annular members include a first member comprised of foam material and a second member comprised of felt material.

10. The improved musical drum of claim 1 wherein said non-adhesive means are incrementally spaced apart.

11. The improved musical drum of claim 1 wherein said non-adhesive means are disposed in a continuous array.

* * * * *